US005503900A

United States Patent [19]

Fletcher

[11] Patent Number: 5,503,900

[45] Date of Patent: Apr. 2, 1996

[54] SNOWBOARD PADDING

[75] Inventor: Herbert E. Fletcher, P.O. Box 4296, San Clemente, Calif. 92674

[73] Assignee: Herbert E. Fletcher, San Clemente, Calif.

[21] Appl. No.: 298,530

[22] Filed: Aug. 30, 1994

[51] Int. Cl.[6] ..... B63B 35/79; A63C 9/02

[52] U.S. Cl. ..... 428/160; 280/11.3; 280/14.2; 280/607; 280/636; 441/70; 441/74

[58] Field of Search ..... 280/11.3, 14.2, 280/607, 636; 441/70, 74; 428/160

[56] References Cited

U.S. PATENT DOCUMENTS

| | | | |
|---|---|---|---|
| 3,437,345 | 4/1969 | Berta | 280/11.13 |
| 3,964,758 | 6/1976 | Kent | 280/613 |
| 4,305,603 | 12/1981 | Muller et al. | 280/607 |
| 4,545,772 | 10/1985 | Stockhausen | 441/74 |
| 4,657,279 | 4/1987 | Pascal et al. | 280/636 |
| 4,871,337 | 10/1989 | Harris | 441/74 |
| 4,894,034 | 1/1990 | Brown, III | 441/65 |
| 4,973,073 | 11/1990 | Raines et al. | 280/624 |
| 5,090,722 | 2/1992 | Ritchie et al. | 280/142 |
| 5,308,271 | 5/1994 | Foulke | 441/74 |

OTHER PUBLICATIONS

Astrodeck 1993—94 Snowboard Catalog (single page flyer).

"Pluck Binding Systems" (pbs) (single page flyer).

*Primary Examiner*—Kriellion S. Morgan

*Attorney, Agent, or Firm*—Loeb and Loeb

[57] ABSTRACT

Padding for use with snowboard bindings that alleviate or reduce slippage of the boot when the boot is in the bindings. The padding comprises a structure 10 further comprising a first member 20 having a top side 12 and a bottom side 14 and a second member 22 having a top side 12 and a bottom side 14. The top side 12 is smooth or flat. In other preferred embodiments, the top side 12 is contoured. Further, in some preferred embodiments, the top side 12 has a logo or emblem. The bottom side 14 has an adhesive back.

27 Claims, 8 Drawing Sheets

SNOWBOARD PADDING

FIELD OF THE INVENTION

This invention relates to snowboard padding that minimizes boot slippage when the boot is in the binding.

BACKGROUND OF THE INVENTION

The sport of snowboarding has recently become very popular. Generally, the sport requires a single board that resembles a very wide ski. Like skiis, current models of snowboards utilize a binding for attaching the snowboard to the user during use.

Typical snowboard bindings include two popular models. One model is a base-type binding. The base-type binding has a flat base piece that is designed to reside directly on the snowboard. (See FIG. 1). In use, a user places the base of his or her boot directly onto the flat base piece of the binding. Thus, with a base-type binding, the user's boot does not directly contact the snowboard.

The second type of popular binding model is a baseless model. The baseless model is similar to the base binding, except that the baseless binding does not have a flat bottom piece. (See FIG. 2). Thus, in use, the bottom of a user's boot is placed directly onto the snowboard. The baseless binding is desirable because it is lighter in weight than the base-type binding.

Although the baseless binding is advantageous in that it is lighter in weight, and therefore, the snowboard is lighter in weight, user's have encountered a problem of boot slippage along the smooth snowboard when the boot is in the binding. User's boots tend to slide sideways and front to back within the baseless binding. This slippage problem has also been encountered with the base binding.

During use, the boots and the upper surface of the snowboard tend to collect water and snow. Usually, some of this water and snow collects in the binding area underneath the boot. Thus, as the boot contacts the water and snow it tends to slide within the binding.

Products currently on the market include snow pads that are placed next to the binding. These snow pads allow the user to remove a boot from a binding and rest it on the top of the snowboard without placing the boot in the binding. However, these products do not resolve the problem of boot slippage within the binding.

SUMMARY OF THE DISCLOSURE

An object of preferred embodiments of the present invention is to provide a non-slip padding that alleviates or reduces the problem of boot slippage within the binding during use. A further object of preferred embodiments of the present invention is to provide the user greater control of the snowboard. Embodiments of the current invention not only achieve these objectives, but allow the user to have a safer, and, with a baseless model, a lighter binding.

Embodiments of the present invention comprise a two part structure having a toe portion and a heel portion. In use, the toe portion resides in the forward portion of the binding and in a location under the toe of the boot when the boot is in the binding. The heel portion resides in the back portion of the binding and in a location under the heel of the boot when the boot is in the binding. The function of the embodiments of the present invention is to prevent the boot from slipping when the boot is in the binding.

BRIEF DESCRIPTION OF THE DRAWINGS

The detailed description of the embodiments of the invention will be made with reference to the accompanying drawings, wherein like numerals designate corresponding parts in the several figures.

DETAILED DESCRIPTION OF THE PREFERRED EMBODIMENTS

Figure 1:
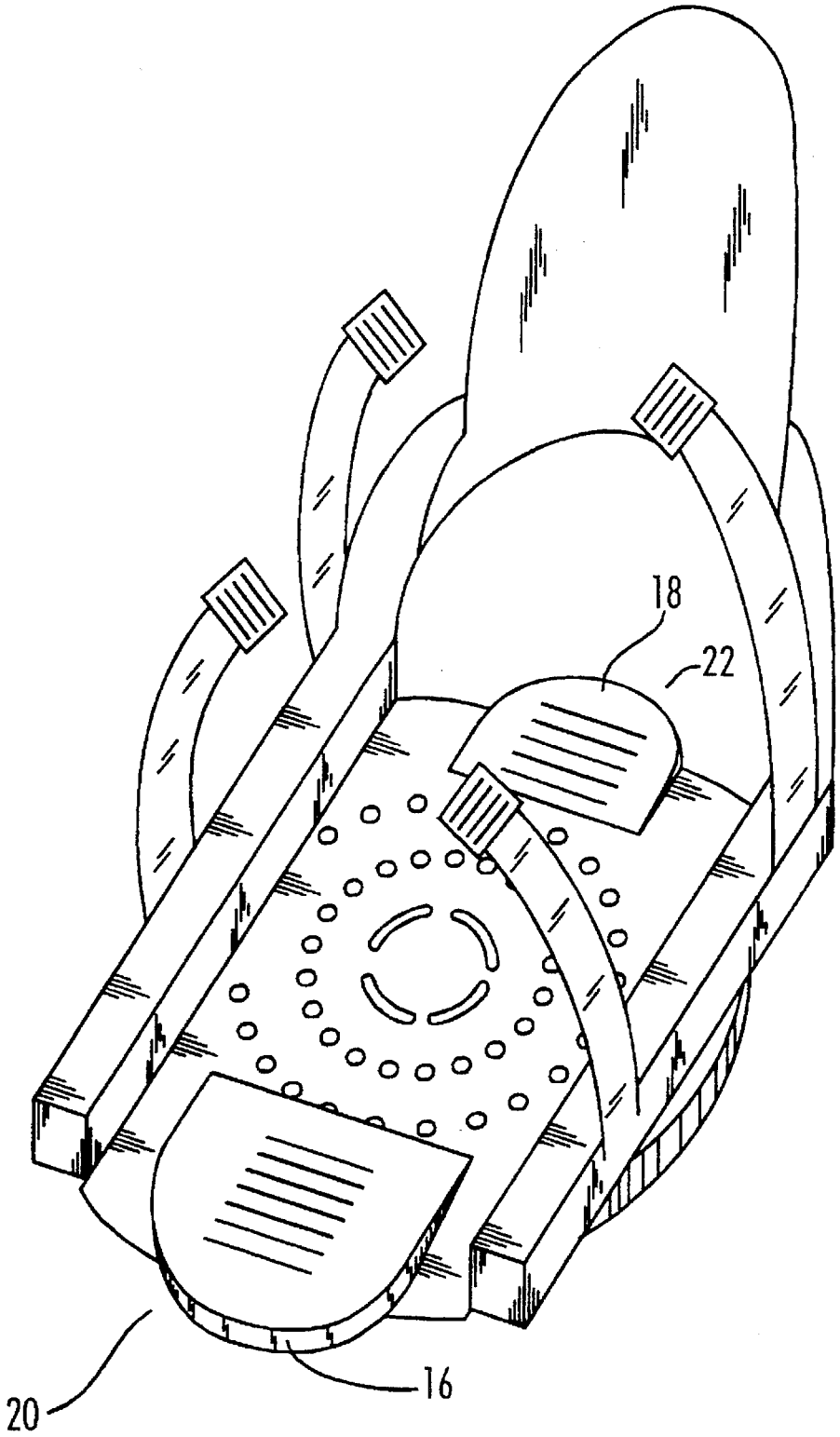
FIG. 1 is a perspective view showing a base binding with a pad arrangement according to an embodiment of the present invention.
Figure 2:
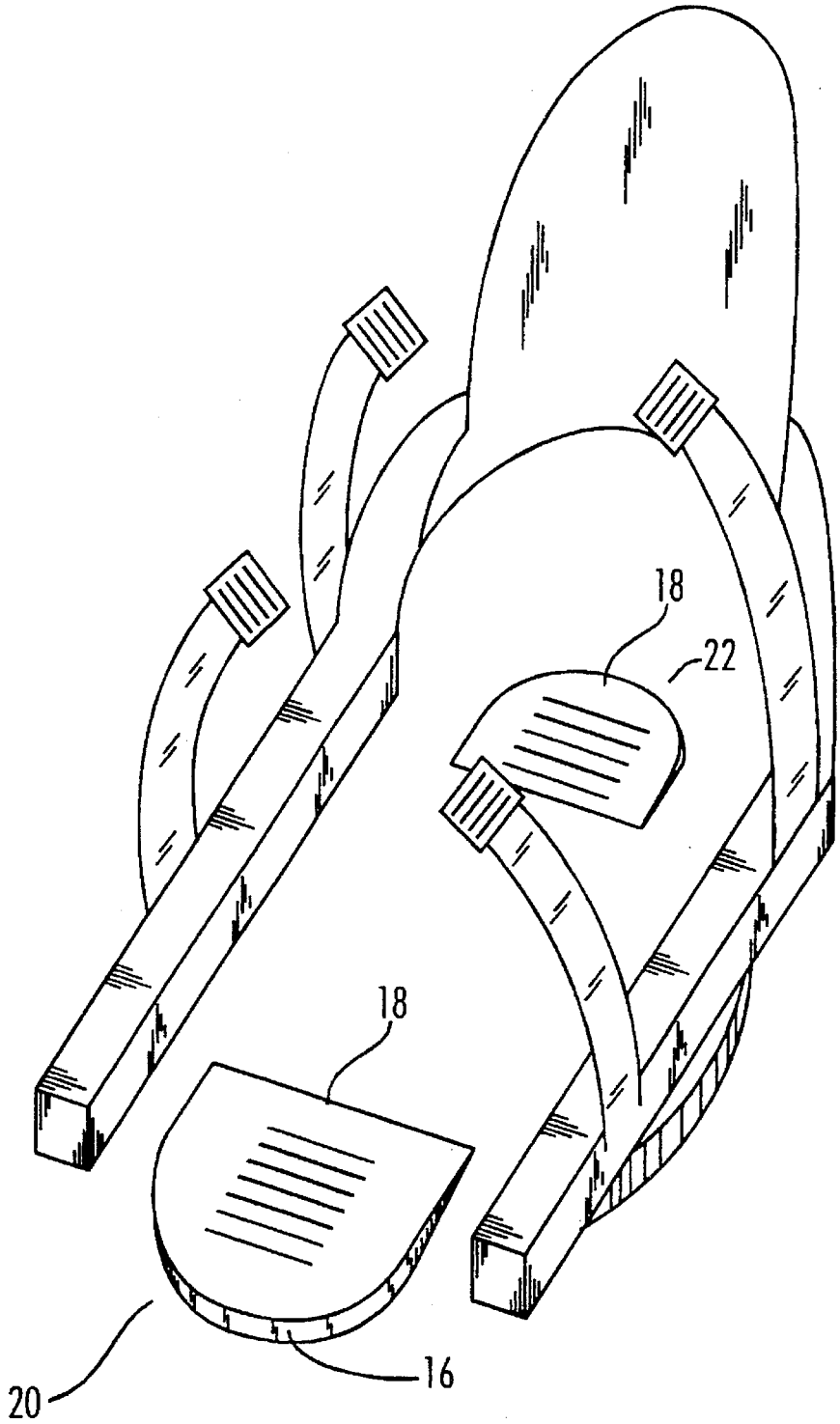
FIG. 2 is a perspective view showing a baseless binding with a pad arrangement according to an embodiment of the present invention.
Figure 3:
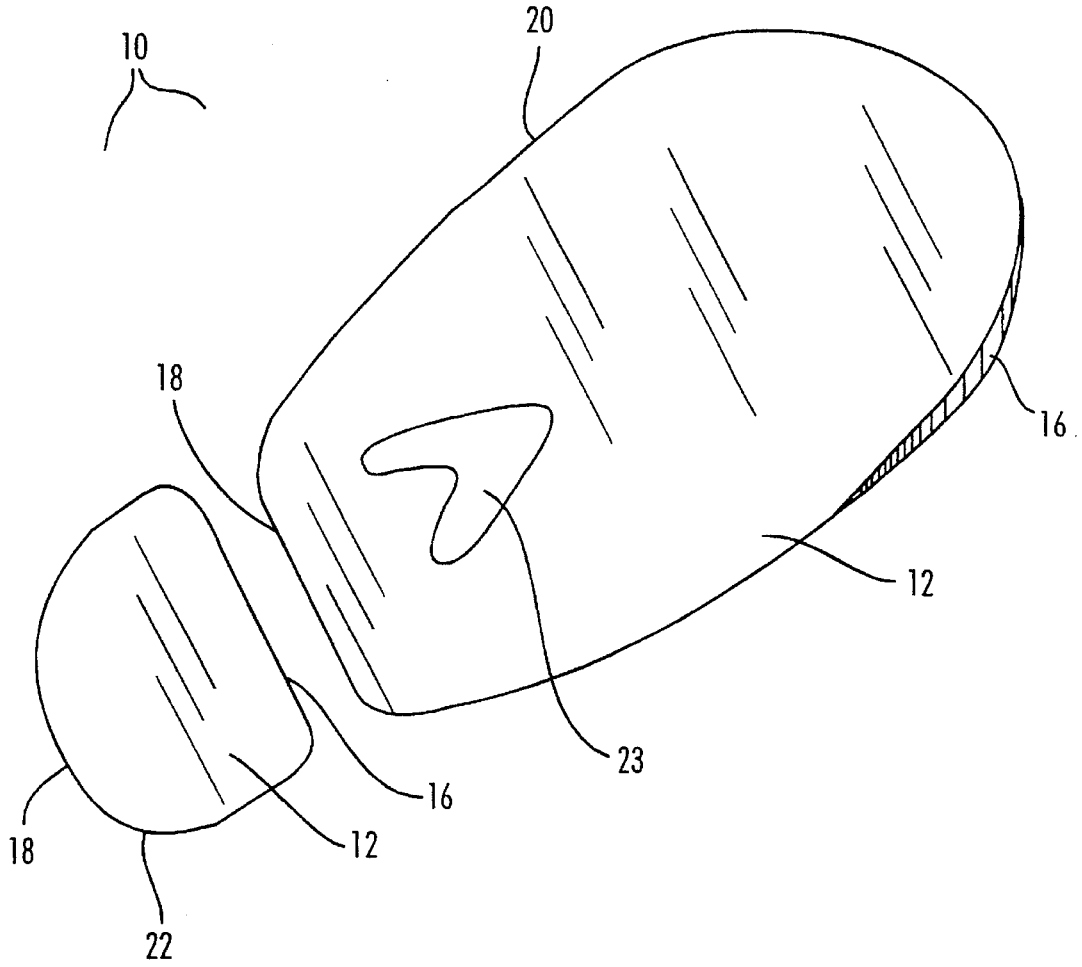
FIG. 3 is a view showing one of the preferred embodiments of the present invention.

FIGS. 1–3 depicts a preferred embodiment of the present invention. Generally, the embodiment shown in FIGS. 1–3 comprises a two part structure 10 which may be employed with a base-type binding (as shown in FIG. 1) or a baseless binding (as shown in FIG. 2). The two part structure 10 has a first member 20 and a second member 22, wherein the first member 20 and the second member 22 each further define a top surface 12, a bottom surface 14, a first end 16 and a second end 18. The first member 20 and second member 22 are separate and independent bodies. The two part structure 10 is preferably made from, but not limited to, soft, rubbery or flexible material, such as foam rubber or soft polyurethane. Alternatively, other materials suitable to prevent boot slippage can be utilized in the structure 10 including, but not limited to, rubber, leather or other animal hides, wood, metal, hard plastics or ceramics.

Figure 5A:
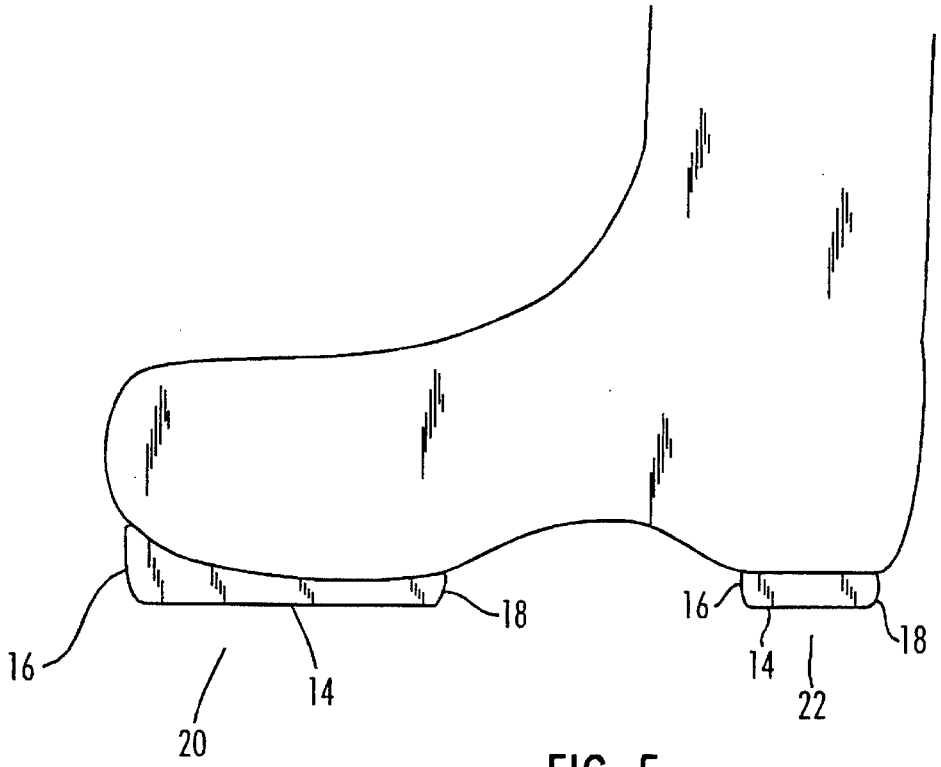
FIG. 5*a* depicts the placement of the boot on one preferred embodiment where the first end of the first member is elevated and the second end of the second member is flat.
Figure 5B:
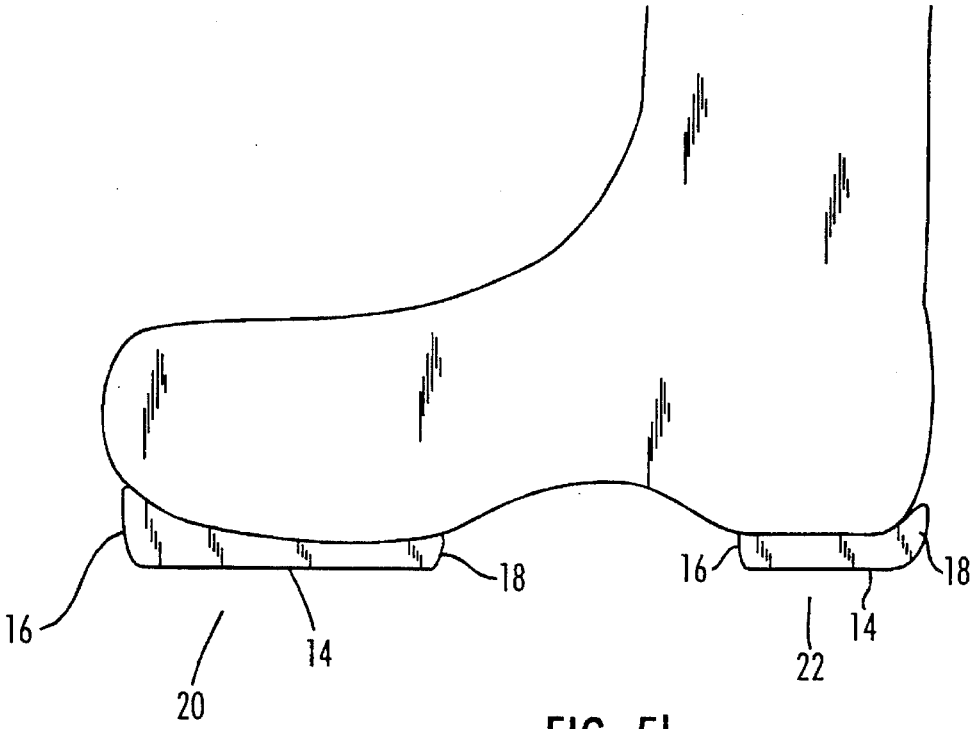
FIG. 5*b* depicts the placement of the boot on one preferred embodiment where the first end of the first member is elevated and the second end of the second member is elevated.

In preferred embodiments, the first end 16 of the first member 20 is thicker than the second end 18, such that the front or toe end of the top surface 12 is elevated when the first member 20 lies flat on the snowboard or binding base. Further, the first member 20 may be provided with an emblem or logo 23 on the top surface 12. In some embodiments, the second end 18 of the second member 22 is thicker than the front end 16 of the second member 22, such that the back or heel end of the surface 12 is elevated when the second member 22 lies flat on the snowboard or binding base. (See FIG. 5*b*).

In preferred embodiments, the bottom surface 22 of the structure 10 has an adhesive coating which readily adheres to the upper surface of a snowboard or binding base. The adhesive coating may be covered with a peel-away sheet prior to being mounted on a snowboard or binding base. The user need only peel away the sheet and apply the structure 10 to the board or binding base. Further embodiments may employ other suitable adhesives, glue, rivots, screws or other mechanisms for securing the structure 10 to the snowboard.

In operation, the bottom side 14 of the first member 20 is designed to be positioned on the snowboard such that the first end 16 is disposed directly below or slightly in front of the toe of a user's boot when the boot is placed in the binding. (See FIGS. 2, 5*a* and 5*b*). Further, the bottom side 14 of the second member 22 is designed to be positioned on the snowboard such that the second end 18 is disposed directly below or slightly behind the heel of a user's boot when the boot is placed in the binding. The two piece construction of structure 10 allows users greater versatility in the placement of the members 20 and 22 on the snowboards. That is, the members 20 and 22 may be placed relatively close together for user with small boots (i.e., defining a relatively short distance from the boot toe to the boot heel) and may be placed further apart for users with larger boots (i.e., defining a greater distance from toe to heel). Thus, embodiments of the invention are not dependent upon the user's boot size. In other preferred embodiments, such as that shown in FIG. 4, the structure 10 is provided as a single contiguous member.

Figure 4:
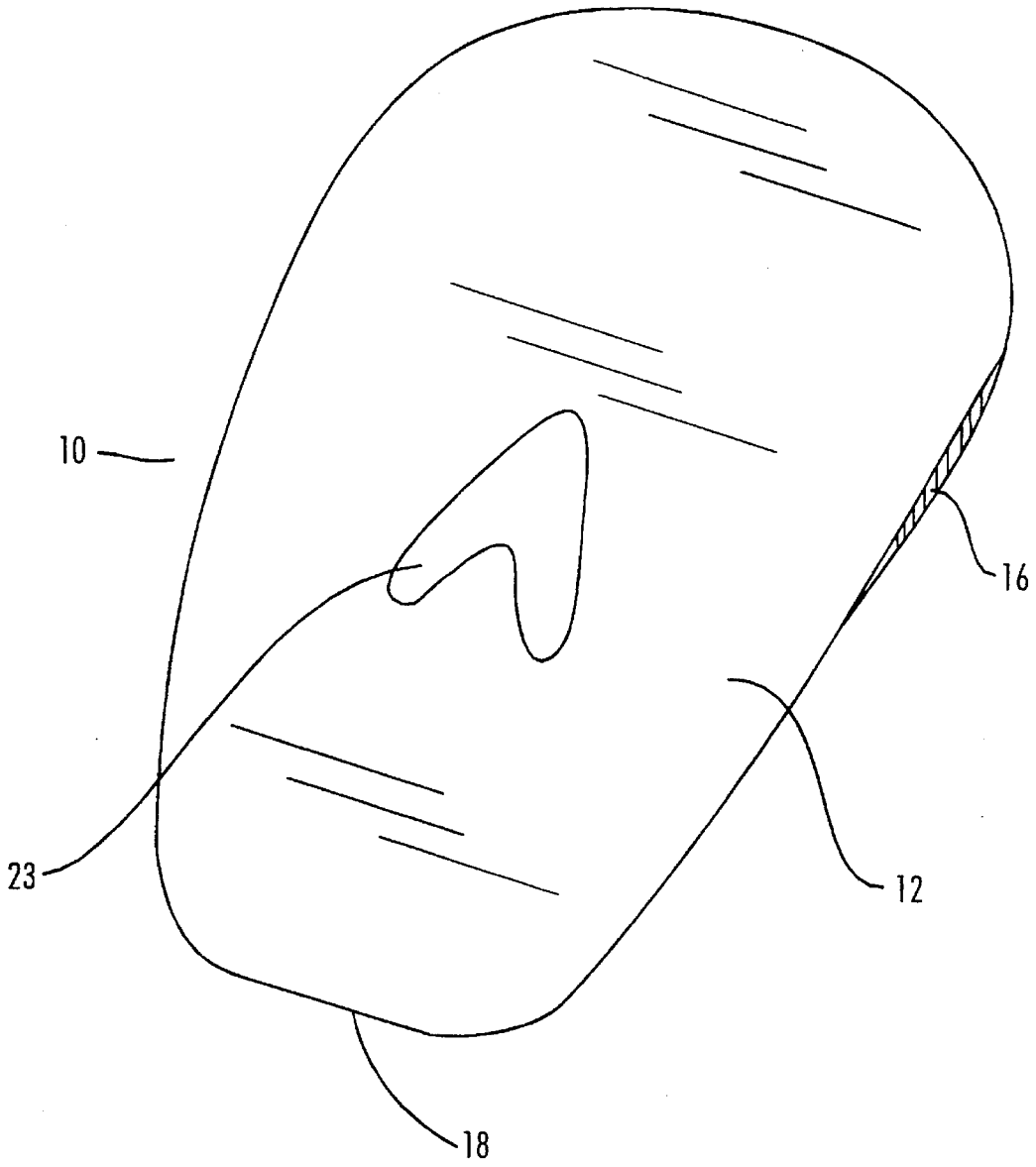
FIG. 4 is a view showing another preferred embodiment of the present invention.

Typically, the first member 20 and the second member 22 are mounted on the snowboard such that they are adjacent, but do not touch each other. Therefore, the toe of the user's boot resides directly on the first member 20 and the heel of the boot resides directly on the second member 22. (See FIGS. 5*a*, 5*b*). Since the middle section of the boot, i.e., the arch, is elevated, it does not contact the snowboard when the boot is in the binding. For alternative embodiments employing a single piece structure 10 (as shown in FIG. 4), the entire boot will reside on the top surface 12 of the structure 10.

The elevated upper surface 12 at the first end 16 of member 20 minimizes forward slippage of the boot when it is in the binding. (See FIGS. 5*a*, 5*b*). Further, the boots used with snowboards typically have elevated toe sections. Therefore, the thicker front portion of the member 22 fills in a gap which would otherwise be present between the toe of the boot and the board and allows the toe section of the boot to maintain constant contact with the snowboard, through the member 22. This provides greater control of the snowboard for the user in that the boot toe can be used for balance and board manipulation. Similarly, the thicker back portion of the second member 22 minimizes backward slippage of the boot when it is in the binding. (See FIG. 5*b*).

As noted above, the upper surface 12 of the structure 10 may be smooth or alternatively, contoured to further minimize boot slippage. FIGS. 6*a*–6*e* illustrate various embodiments of contoured upper surfaces.

The contour shapes are preferably cut out (e.g., die cut), rather than pressed into the structure during manufacturing. This allows the formation of sharp corners 24 which maximize friction and, thus, the ability to inhibit boot slippage.

Figure 6A:
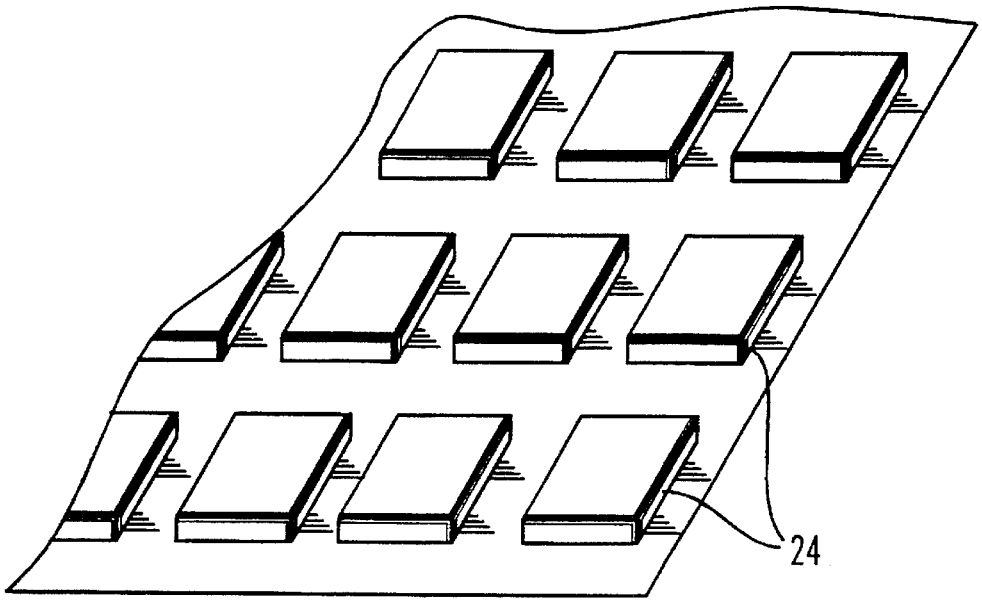
FIG. 6*a* is an illustration of a portion of the surface of a preferred embodiment of the invention.
Figure 6B:
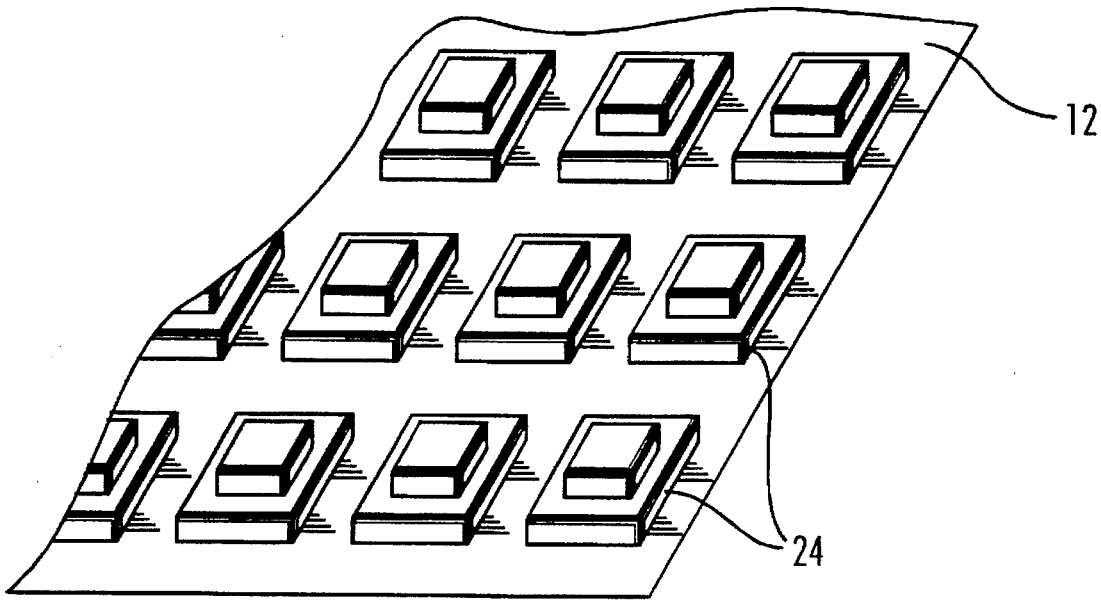
FIG. 6*b* is another illustration of a portion of the surface of a preferred embodiment of the invention.
Figure 6C:
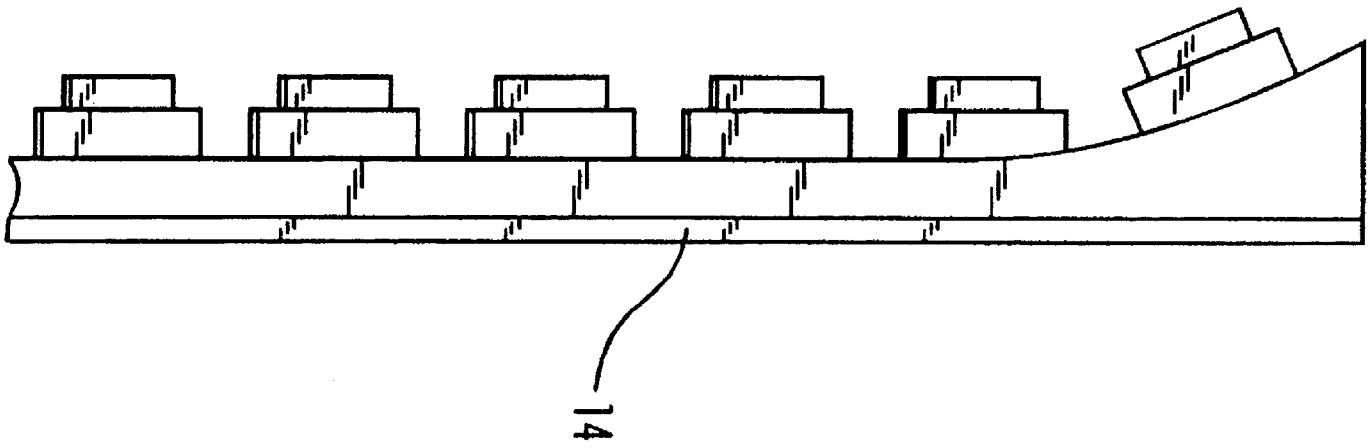
FIG. 6*c* is a side view of a portion of a preferred embodiment of the invention depicting the surface illustrated in FIG. 6*b*.
Figure 6D:
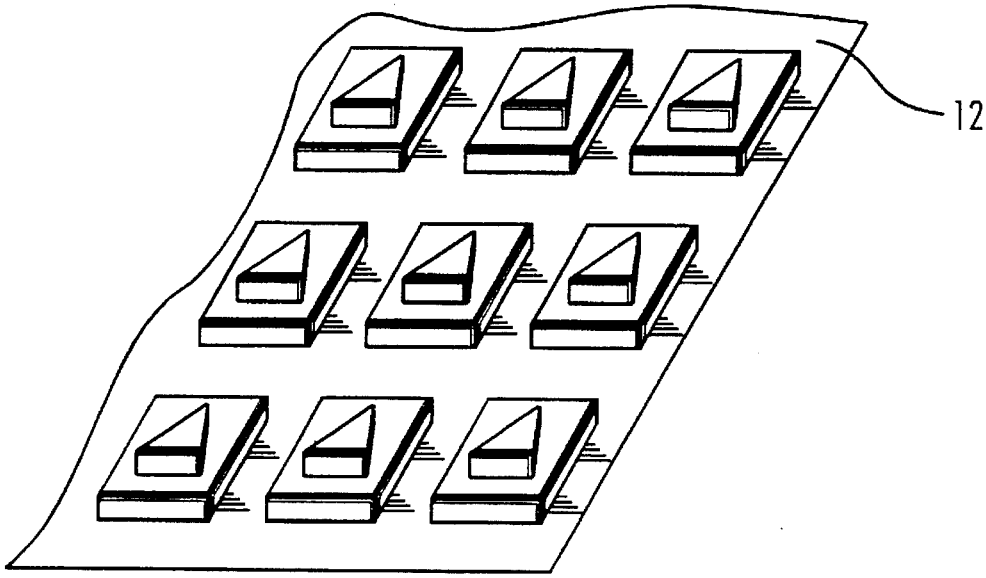
FIG. 6*d* is another illustration of a portion of a preferred embodiment of the surface of the invention.
Figure 6E:
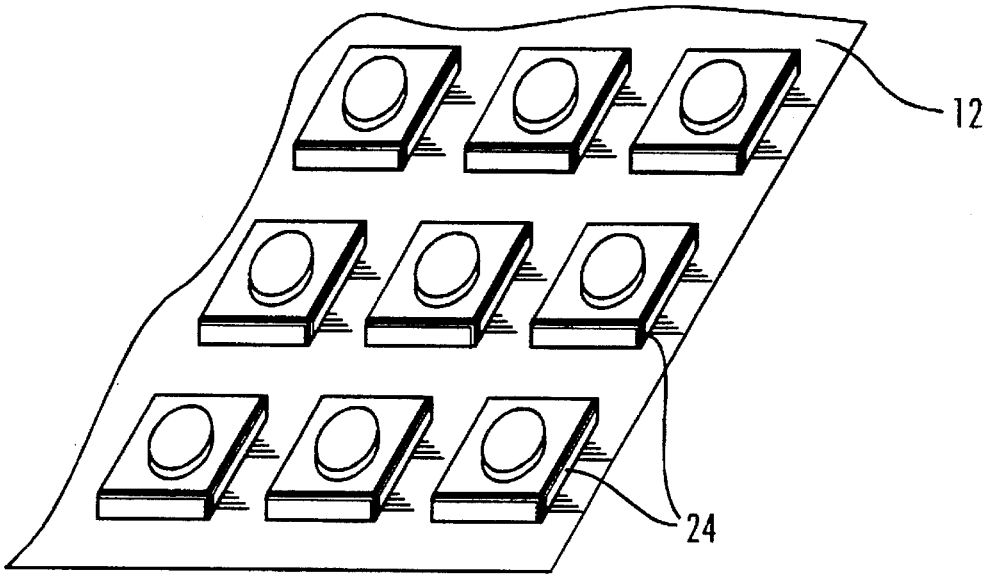
FIG. 6*e* is another illustration of a portion of a preferred embodiment of the surface of the invention.

FIG. 6*a* illustrates an upper surface where the cross section of the contour is a square. Other embodiments may employ contours where the cross sections are circles, triangles, ovals, hexigons, other polygons or other suitable geometric patterns or shapes. In further embodiments a second contour is disposed on the top of a first contour. (See FIGS. 6*b*–6*e*).

Embodiments of the present invention reduce side to side slippage, as well as, front and back slippage. The multi-member embodiment allows for ready usage with boots and bindings of virtually all boot sizes. Further, the multi-member embodiment reduces the amount of damage imparted to the snowboard due to attachment of the padding on less surface area of the snowboard. Embodiments of the present invention provide greater safety and control in the use of snowboards by alleviating or reducing boot slippage when the boot is in the binding.

Although the foregoing described the invention with preferred embodiments, this is not intended to limit the invention. Rather, the foregoing is intended to cover all modifications and alternative constructions falling within the spirit and scope of the invention as expressed in the appended claims.

What is claimed is:

1. A non-slip padding for use with a snowboard binding attached to a snowboard, the padding comprising:

a pad structure having a top surface, a bottom surface, a first end and a second end, wherein the first end of the structure is thicker than the second end of the structure; and means for securing the pad structure to the snowboard, within the snowboard binding.

2. A non-slip padding as claimed in claim 1 wherein the pad structure is made from flexible material.

3. A non-slip padding as claimed in claim 2 wherein the flexible material is foam rubber.

4. A non-slip padding as claimed in claim 2 wherein the flexible material is polyurethane.

5. A non-slip padding as claimed in claim 1 wherein the means for securing comprises an adhesive applied to the bottom surface of the pad structure.

6. A non-slip padding as claimed in claim 1 wherein the top surface at the second end of the pad structure is elevated when the pad structure is disposed on the snowboard.

7. A non-slip padding as claimed in claim 1 wherein the top surface is smooth.

8. A non-slip padding as claimed in claim 1 wherein the top surface is contoured.

9. A non-slip padding as claimed in claim 1 wherein the structure has an emblem disposed on the top surface.

10. A non-slip padding as claimed in claim 1 wherein the pad structure is composed of first and second separable pads.

11. A non-slip padding as claimed in claim 8 wherein the contoured top surface includes a first contour disposed on a second contour.

12. A non-slip padding for use with a snowboard binding attached to a snowboard, wherein the snowboard binding has two spaced-apart boot-entrapping members exposing a supporting base therebetween, the padding comprising:

a pad structure having a top surface, a bottom surface, a first end and a second end; and means for securing the pad structure to the supporting base, wherein the pad structure is secured between and spaced-apart from the boot-entrapping members.

13. A non-slip padding as claimed in claim 12 wherein the first end of the structure is thicker than the second end of the structure.

14. A non-slip padding as claimed in claim 12 wherein the pad structure comprises first and second separable pads.

15. A non-slip padding as claimed in claim 12 wherein the pad structure is made from flexible material.

16. A non-slip padding as claimed in claim 12 wherein the means for securing comprises an adhesive applied to the bottom surface of the pad structure.

17. A non-slip padding as claimed in claim 12 wherein the top surface at the second end of the pad structure is elevated when the pad structure is disposed on the snowboard.

18. A non-slip padding as claimed in claim 12 wherein the top surface is contoured.

19. A non-slip padding as claimed in claim 18 wherein the contoured top surface includes a first contour disposed on a second contour.

20. A method for providing a non-slip surface within a snowboard binding attached to a snowboard, wherein the snowboard binding has two spaced-apart boot-entrapping members for holding a boot therebetween, the method comprising the steps of:

providing a pad structure having a top surface, a bottom surface, a first end and a second end, wherein the first end of the structure is thicker than the second end of the structure; and securing the pad structure to the supporting base between boot-entrapping members.

21. A method as claimed in claim 20 wherein the securing step includes securing the pad structure spaced-apart from the boot-entrapping members.

22. A method as claimed in claim 20 wherein the first pad structure is composed of first and second separable pads and the step of securing the pad structure comprises securing the first and second pads to the snowboard, between the boot-entrapping members with the first pad being spaced apart from the second pad.

23. A method as claimed in claim 20 wherein the pad structure is made from flexible material.

24. A method as claimed in claim 20 wherein the step of securing includes applying an adhesive to the bottom surface of the pad structure.

25. A method as claimed in claim 20 wherein the step of securing includes elevating the top surface at the second end of the pad structure when the pad structure is disposed on the snowboard.

26. A method as claimed in claim 20 wherein the top surface is contoured.

27. A method as claimed in claim 26 wherein the contoured top surface includes a first contour disposed on a second contour.

* * * * *